United States Patent [19]

Van Hagan et al.

[11] 4,212,351

[45] Jul. 15, 1980

[54] ARTICULATED MODULE FLOW GUIDE SYSTEM

[75] Inventors: Thomas H. Van Hagan, Encinitas; David E. Tanner, Poway, both of Calif.

[73] Assignee: The United States of America as represented by the United States Department of Energy, Washington, D.C.

[21] Appl. No.: 889,291

[22] Filed: Mar. 23, 1978

[51] Int. Cl.[2] ..... F28F 1/42

[52] U.S. Cl. ..... 165/160; 165/162; 176/61; 176/65

[58] Field of Search ..... 165/158, 160, 162; 122/32, 325, 324; 176/19 R, 17, 28, 61.65

[56] References Cited

U.S. PATENT DOCUMENTS

| | | | |
|---|---|---|---|
| 3,941,188 | 3/1976 | Scheidl | 165/162 |
| 3,957,575 | 5/1976 | Fauth, Jr. | 176/28 |
| 4,013,121 | 3/1977 | Berger et al. | 165/162 |
| 4,098,329 | 7/1978 | Culver | 122/32 |

*Primary Examiner*—Samuel Scott
*Assistant Examiner*—Theophil W. Streule, Jr.
*Attorney, Agent, or Firm*—R. V. Lupo; Roger S. Gaither; William S. Bernheim

[57] ABSTRACT

A system is disclosed for promoting selective shell-side flow distribution between and providing structural support for modular straight tube bundles in a heat exchanger or the like, wherein a plurality of flow guides, each of which includes three axi-symmetrically-located radial panels, are connected along their outer radial edges to form a polygonal array establishing mutually shared partitions between modular tube bundles. Various flow guide configurations permit gaps in the mutually shared partitions to promote uniform shell-side communication between the modules, and accommodate individual tube bundle support grids in assembled relation with the flow guides.

13 Claims, 4 Drawing Figures

ARTICULATED MODULE FLOW GUIDE SYSTEM

The present invention relates generally to heat exchangers, and more particularly to a novel flow guide arrangement employing discrete flow guides connected in a manner to shroud modular tube bundles in a heat exchanger and provide structural support and rigidity for the tube bundles while also promoting selective shell-side flow distribution between adjacent tube bundles.

Known tubular counterflow heat exchanger designs, such as employed in high temperature gas cooled reactors, are characterized by their modular construction and the direct influence that their overall diameter has on the size of the prestressed concrete reactor vessel. This has led to designs in which modular tube bundles are packaged as contiguous hexagons to approach the compactness of homogeneous tube fields. To help guide shell-side flow and to provide structural support in the modular array, shrouding of the modules is generally required. The current state of the art provides for individually shrouding tube bundles, accomplished either by inserting each tube bundle into a hexagonal shaped can, or by building the shroud-work around each tube bundle. Both of these methods are difficult to assemble and are prone to potential fitup problems due to tolerance accumulation over the modular array.

One of the primary objects of the present invention is to provide an articulated module flow guide system employing novel flow guides adapted for assembly to provide structural support for and promote uniform shell-side flow distribution between modular tube bundles in a heat exchanger.

A more particular object of the present invention is to provide a system for supporting and promoting uniform shell-side flow distribution between modular straight tube bundles in a heat exchanger, which system employs a plurality of substantially identically shaped flow guides adapted to be integrally assembled into a polygonal array establishing mutually shared partitions between the modular tube bundles.

Another object of the present invention is to provide an articulated module flow guide system employing a plurality of novel discrete flow guides each of which has three axi-symmetrically-located radial panels having outer edges adapted for connection to the outer edges of similar flow guides to establish a lattice work defining mutually shared partitions between adjacent polygonal modular tube bundles in a heat exchanger, the mutually shared partitions being selectively adapted to promote uniform shell-side flow distribution between adjacent tube bundles, provide structural rigidity for the modular tube bundles, and eliminate the need for seals between modular tube bundles to prevent shell-side flow bypass around the tube bundles.

A feature of the present invention lies in the employment of substantially identically shaped symmetrical flow guides to create the flow guide lattice whereby tolerance control, handling and installation of modular tube bundles into a heat exchanger is greatly facilitated, with visual and manual access to the tube bundles and their supports during assembly being significantly enhanced. The height of the resulting assembly is governed by the quantity of flow guides employed in the assembly.

Another feature of the present invention lies in the provision of novel flow guides adapted for integral assembly in a manner to establish shrouding circumferentially of polygonal shaped modular straight tube bundles, the flow guides being adapted to establish gaps in the mutually-shared partition panels at discrete axial intervals to provide selected shell-side flow whereby even temperature distribution between the modular tube bundles is effected.

A further feature of the articulated module flow guide system in accordance with the present invention lies in the ability of the flow guides to accommodate individual tube bundle support grids in assembled relation therewith such that radial outer hinge axes of the flow guides and tube support grids stack up to form pinned solid columns extending the full length of the lattice.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
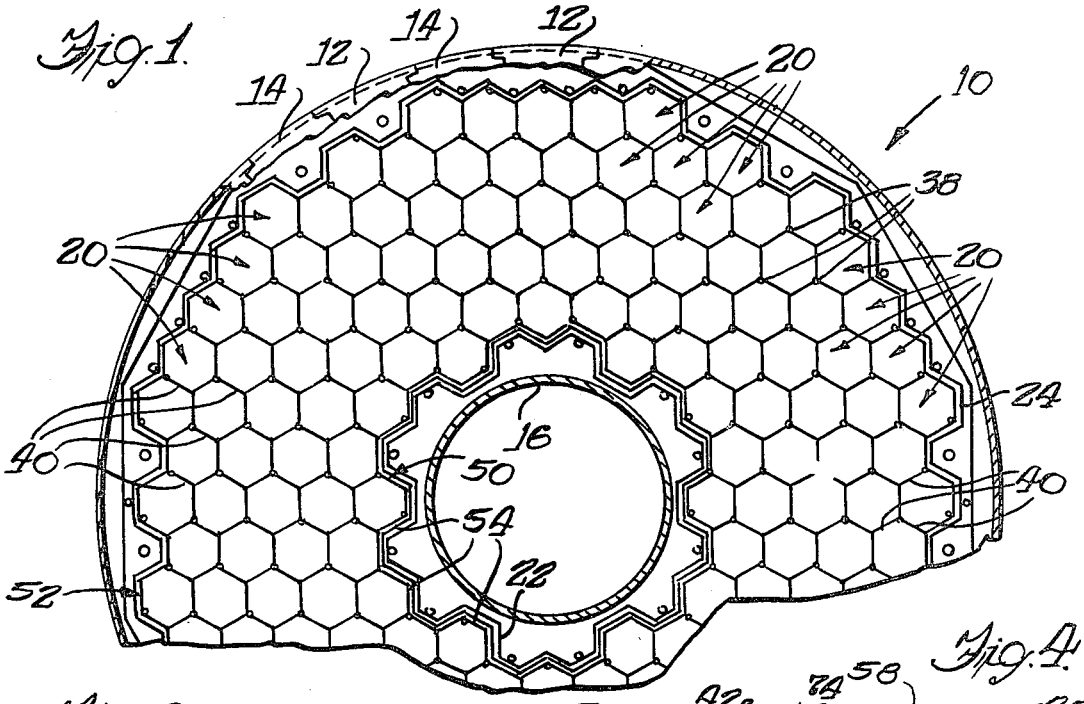
FIG. 1 is a fragmentary transverse sectional view of a recuperator for a gas cooled nuclear reactor wherein the recuperator employs modular tube bundles maintained in assembled relation by an articulated modular flow guide system in accordance with the present invention.
Figure 3:
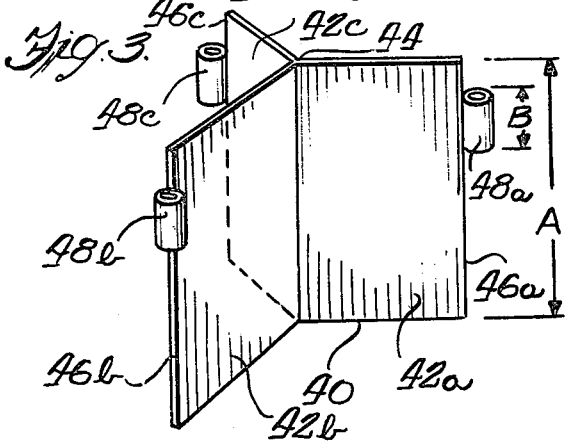
Figure 4:
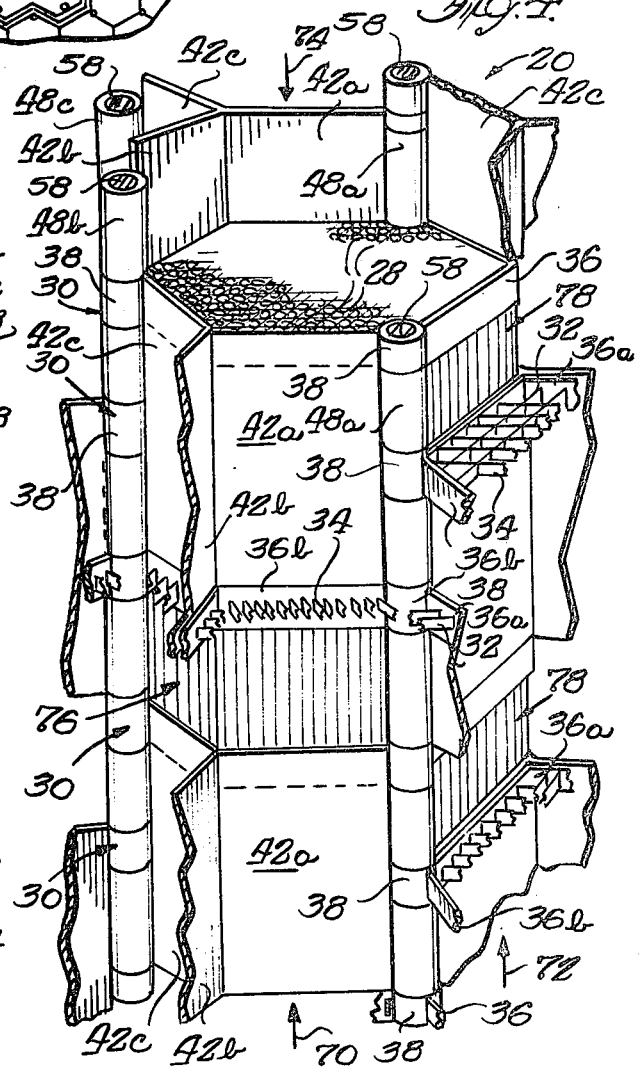

FIG. 3 is a perspective view, on an enlarged scale, of a single flow guide as employed in the modular flow guide system of FIG. 1; and FIG. 4 is a fragmentary perspective view showing a modular tube bundle employing flow guides and tube support grids in accordance with the present invention, the flow guides establishing gaps at discrete axial locations along the tube bundle for shell-side flow communication between tube bundles.

Referring now to the drawings, and in particular to FIG. 1, an articulated modular flow guide system in accordance with the present invention is illustrated, by way of example, as being embodied in the heat recuperator portion of a high temperature gas cooled reactor, a portion of the recuperator being indicated generally at 10. The recuperator 10, which may alternatively be termed the reactor heat exchanger, may be housed within a prestressed concrete reactor vessel and is of generally circular configuration bounded on its outer periphery by a plurality of axially disposed seal members 12 and 14 of known design maintained in assembled relation by a plurality of circumferential retaining bands (not shown) in a conventional manner. The recuperator 10 has an axial cylindrical passage 16 formed therethrough defining with the outer cylindrical boundary of the recuperator an annular space in which a plurality of modular tube bundles, each of which is indicated generally at 20, are disposed. Suitable inner and outer tube bundle boundaries 22 and 24 of known design are formed adjacent the innermost and outermost tube bundles 20 to maintain the structural integrity of the recuperator 10.

Very generally, the articulated modular flow guide system of the present invention employs a plurality of flow guides each of which includes three axi-symmetrical radial panels integrally connected at their radial inner edges and defining connecting sleeves at their radial outer edges. The flow guides are connectible through their connecting sleeve edges to form an array of hexagonal flow tube chambers having mutually shared partitions. The connecting sleeve edges of the flow guides are of predetermined axial length to facilitate solid stacking of the sleeve edges with interposed tube support grids which maintain the individual flow tubes in fixed relation within each hexagonal modular tube bundle 20. The axial lengths of the flow guide connecting sleeve edges may be established so that when a plurality of flow guides are interconnected with flow tube support grids, gaps of predetermined area may be formed between adjacent tube bundles to provide shell-side communication between the modular tube bundles.

Figure 2:
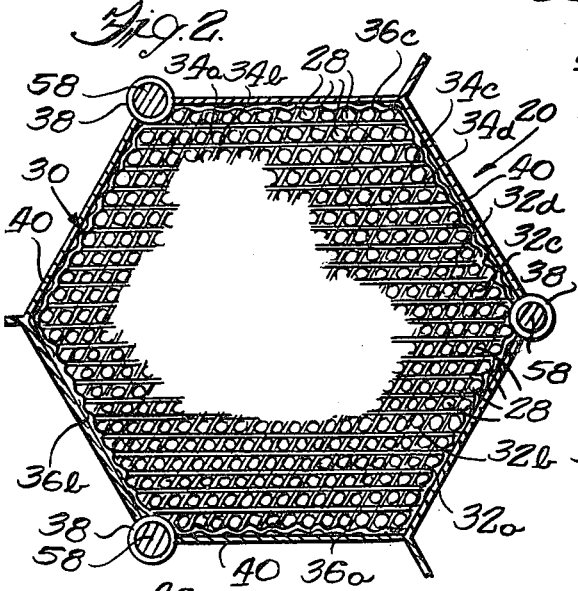
FIG. 2 is a fragmentary transverse sectional view, on an enlarged scale, of a single modular tube bundle as employed in the recuperator of FIG. 1, the tube bundle being shown with one of its tube support grids interconnected with flow guides in accordance with the present invention.

FIG. 2 is an enlarged fragmentary transverse sectional view illustrating one of the modular tube bundles 20 employed in the recuperator 10 of FIG. 1. The modular tube bundle 20 includes a plurality of straight flow tubes 28 which are maintained in parallel assembled relation by axially aligned tube support grids, one of which is shown at 30, having a first set of parallel spacing bars or plates 32*a, b, c, d,* etc. disposed in generally transverse fixed assembled relation with a second set of spacing bars or plates 34*a, b, c, d,* etc. The opposite ends of the individual spacing bars 32*a, b,* etc. and 34*a, b,* etc. are secured to a hexagonal shaped frame 36 which includes three frame plate members 36*a, b* and *c* connected at their opposite ends to tubular connecting joints or sleeves 38 equidistantly spaced about the center of the hexagonal tube support grid. The spacing bars 32*a, b, c,* etc. and 34*a, b, c,* etc. are uniformly spaced so as to establish a uniform grid or array of openings each of which receives an individual flow tube 28 in side supporting relation therein. The three connecting sleeves 38 formed at alternate corners of each hexagonal shaped support grid 30 facilitate assembly of a plurality of the tube support grids within each modular tube bundle 20 in axially aligned relation. As will become more apparent hereinbelow, the tube support grids 30 also facilitate assembly of a plurality of hexagonal tube bundles as contiguous tube bundles to approach the compactness of a homogeneous tube field, as shown in FIG. 1.

When assembled to form a recuperator 10 as shown in FIG. 1, the upper and lower ends of the straight flow tubes 28 are connected to suitable subheaders (not shown) to facilitate the flow of a fluid, such as helium from the outlet of the compressor in a closed cycle gas turbine, through the flow tubes so that it can be preheated in a known manner before leaving the recuperator. After passing through the reactor core, where it serves as a coolant, and thence through a turbine, where it is expanded to produce work to produce power and drive the compressor, this hot helium is passed to the recuperator where the high temperature gas is caused to flow along the external surfaces of the flow tubes 28. The high temperature helium gas from the turbine becomes the heating medium for the recuperator to preheat the compressor discharge helium flowing within the flow tubes 28 during which heat exchange from the high temperature gas to the lower temperature fluid flowing within the flow tubes 28 is effected.

In heat exchangers employing modular tube bundles such as the aforedescribed hexagonal tube bundles 20, it has been found that shrouding of each modular tube bundle is desirable to promote shell-side flow and provide suitable structural support in the modular array of tube bundles. It is known, for example, that without suitable shrouding of the tube bundles, cross flow gradients (flow non-parallel to the flow tubes) may result due to "short circuits" created by paths of lesser flow resistance through the tube bundles. In accordance with known shrouding techniques, shrouding of the individual tube bundles is accomplished either by inserting each tube bundle into a hexagonal can or by constructing the shroud work around each tube bundle. Both of these techniques require difficult assembly and are prone to potential fitup problems due to tolerance accumulation over the modular array.

In accordance with the present invention, a system of flow guides 40 is provided to shroud the individual modular tube bundles and promote improved uniform shell-side flow distribution between adjacent modular tube bundles while also providing structural rigidity for the array of tube bundles. Referring particularly to FIGS. 3 and 4, each flow guide 40, which may be termed a flow guide element, includes three axi-symmetrically located radial panels 42*a, b* and *c* which are of equal size and configuration so as to be symmetrical about the axis of the flow guide. The radial panels 42*a, b* and *c* are integrally connected together along their inner longitudinal edges to define the longitudinal axis of the flow guide, as at 44. Each panel 42*a, b* and *c* defines connecting edge means at its radial outer edges 46*a, b* and *c,* respectively. In the illustrated embodiment, such connecting edge means are defined by tubular connecting sleeves 48*a, b* and *c,* alternatively termed hinge sleeves, which are preferably formed integral with the respective panels 42*a, b* and *c.*

The flow guides 40 are made of a suitable metallic material and, through their respective connecting sleeves 48*a, b* and *c,* are adapted for interconnection with the connecting sleeves of similar flow guides so that a plurality of the flow guides may be assembled to form a polygonal lattice work defining mutually shared partitions between hexagonal tube bundle receiving chambers.

To this end, the connecting sleeves 48*a, b* and *c* on each flow guide 40 are of equal axial length and are positioned along their respective outer radial edges 46*a, b* and *c* at equal axial positions thereon. By forming the tubular connecting sleeves 48*a–c* on each of the flow guides 40 of predetermined axial length relative to the overall axial length or height of the respective flow guide, a plurality of open windows or gaps, alternatively termed shell-side flow openings, may be created at predetermined discrete axial locations along the lengths of the tube bundles 20 after assembly of the flow guides to form the array of tube bundles illustrated in FIG. 1.

With the exception of the inner and outer lattice edges, indicated at 50 and 52 in FIG. 1 adjacent the inner and outer boundaries 22 and 24, respectively, of the modular tube bundle array, all of the flow guides 40 employed in the array of module tube bundles may be identical. In assembling the various tube bundles 20, associated tube support grids 30 and flow guides 40 into the modular array illustrated in FIG. 1, assembly is begun from the inner lattice edge 50. The inner lattice 50 is formed by interconnection of flow guides 40 with flow guides 54 which are similar to the flow guide elements 40 except that they include only two of the three axi-symmetrical panels 42*a, b* and *c* formed on the flow guides 40. Assembly of the array of flow guides 40 is effected by progressively interconnecting the connecting sleeves 48 of the flow guides from the center of the array radially outwardly to the outer boundary 52, and progressively upwardly from the bottom of the array to the desired height of the recuperator 10. Referring to FIG. 4, it is seen that the connecting sleeves 48 of the respective flow guides forming a hexagonal tube bundle receiving chamber are positioned in axially aligned relation with each other and with the connecting sleeves 38 of selectively positioned tube support grids 30 whereafter hinge pins, such as indicated at 58 in FIG. 4, are inserted axially through the vertically aligned connecting sleeves. The hinge pins 58 may comprise continuous length pins of sufficient axial length to extend the full vertical height of the assemblage of flow guides about each of the tube bundles, or may comprise a series of shorter length connecting pins each of which is adapted to extend through at least two axially aligned connecting sleeves of contiguous flow guides and acts as a shear pin.

It is seen that as the various flow guides 40 are assembled as illustrated in FIG. 4, two panels 42*a, b* or *c* of each of the flow guide elements cooperate with two panels of each of two other flow guides to circumferentially surround or shroud the associated tube bundle 20. In the illustrated embodiment, a connecting sleeve 38 of a tube support grid 30 is axially stacked between each of the axially aligned connecting sleeves 48 of the various flow guides, with the respective hinge pins 58 being inserted axially downwardly through the aligned connecting sleeves 38 and 48.

It is seen from FIG. 4 that in the illustrated embodiment discrete gaps or openings are formed between each vertically adjacent pair of flow guides 40, considered upwardly along a single tube bundle, with each gap having a lateral extent, transversely of the axis of the tube bundle, encompassing two of the six sides of each hexagonal tube bundle. The gaps are created circumferentially about each tube bundle in a generally progressive or uniform helical fashion along the axial length of the tube bundle.

For example, it is seen from FIG. 4 that in assembling a plurality of the flow guides 40 with tube support grids 30 so as to establish a hexagonal selectively shrouded tube bundle, a plurality of vertically aligned flow guides, indicated generally by arrow 70, are interconnected through their connecting sleeves 48 to a plurality of vertically aligned flow guides as indicated by the arrow 72, both vertically aligned columns of flow guides 70 and 72 being in turn interconnected to a third plurality of vertically aligned flow guides represented by the arrow 74. It is seen that a gap, represented at 76, is established between each of the flow guides 40 in the vertical column 70. Similarly, gaps, indicated at 78, are formed between the vertically aligned flow guides in the vertical column 72. In similar fashion, gaps are established between the vertically aligned flow guides as represented at 74. In the illustrated embodiment, the length of each connecting sleeve 48 is such that, when axially combined with a connecting sleeve 38 of an associated tube support grid 30, a cumulative length is formed equal to approximately one-half the full axial length of the associated flow guide. This serves to establish a cumulative gap or open side-flow area about the modular hexagonal tube bundle equal to approximately 33% of the circumferential area of the tube bundle. It is noted that the gaps, as represented at 76 and 78 in FIG. 4, are staggered in a generally helical fashion about and along the length of the associated tube bundle and have a uniform "repeat" throughout the length of the modular tube bundle.

It is also seen from FIG. 4 that the support tube grids 30 are interconnected with the flow guides 40 so that, for a given connecting axis 58, every third tube support grid will extend into the same one of three contiguous hexagonal tube bundles sharing a common connecting axis. In this manner, the tube support grids for each tube bundle are substantially equally spaced along the full length of the associated tube bundle.

In assembling an array of modular tube bundles 20 having associated flow guides 40 and tube support grids 30 in accordance with the assemblage illustrated in FIG. 1, the assembly of flow guides, tube support grids and flow tubes 28 proceeds outwardly in radial increments from the inner boundary 22 until the desired radial width of the recuperator is obtained, whereafter outer flow guides 54 are interconnected with the radially outermost flow guides 40 to establish the outer boundary of the assemblage of modular tube bundles.

The total open gap area circumferentially of a given tube bundle 20 after assembly of identically shaped flow guides 40 about each tube bundle may be established by predetermined selection of the lengths of the connecting sleeves 48*a–c*. Assume, for purposes of example, that a plurality of flow guides 40 are assembled about a tube bundle 20 so that two radial panels 42 of each flow guide assist in forming two of the six boundary walls of the resulting hexagonal tube receiving chamber, and that the flow guides are assembled without tube support grids 30 interconnected therewith. The total gap area created about such a tube bundle may be expressed as a percentage of the maximum circumferential area of a modular tube bundle 20 that may be shrouded by flow guides according to the following formula:

gap area (as a percentage of maximum shrouding area)$=A/3B$ where:

A=the overall axial length of each flow guide 40 (indicated at "A" in FIG. 3), and B=the axial length of each connecting sleeve 46*a, b* and *c* (indicated at "B" in FIG. 3).

Stated alternatively, by dividing the axial length "A" of a flow guide 40 by a factor equal to three times the axial length "B" of one of its connecting sleeves 48*a, b, c*, the gap or open window area about a tube bundle 20 may be determined as a percentage of maximum shrouding area that may be obtained circumferentially of the tube bundle. For example, if the axial length "A" of a flow guide 40 is approximately 15 inches and the axial length "B" of each of its connecting sleeves 48*a–c* is 5 inches, assembly of similar shaped flow guides so that their connecting sleeves are in solid stacked axial alignment along the full length of the resulting tube bundle will result in 100% shrouding, i.e. zero gap area, of the tube bundle. When tube support grids 30 are interposed in stacked relation with the flow guides 40 in assembling the polygonal array of flow guides, the axial length "B" of each tubular connecting sleeve 48*a–c* must be reduced by a value equal to the axial length of the tube support grid sleeves 38 so that the cumulative axial length of a flow guide connecting sleeve 48 and an associated tube support grid sleeve 38 results in the desired percentage gap area for each of the tube bundles.

It will be appreciated that in accordance with the aforementioned formula for establishing predetermined gap areas circumferentially of a modular tube bundle to facilitate shell-side flow communication between adjacent tube bundles, a tube bundle will have 100% shrouding if the length "B" of the flow guide connecting sleeves 48*a–c* is made to equal one-third the full axial length or height of the corresponding flow guide, again, considered without assembly of the flow guides with tube support grids 30. Thus, the maximum ratio of A/B is 3. If the length "B" of the connecting sleeves 48*a–c* is greater than one-third the overall length of the corresponding flow guide, the gap area, as a percentage of the total boundary area of a tube bundle which may be fully shrouded, may be increased. For example, if the connecting sleeve lengths "B" are equal to one-half the length of the flow guide (without employing interconnected tube support grids 30), approximately 66% shrouding will be achieved with approximately 33% gap area. If the length "B" is increased to two-thirds the length of the flow guide, 50% gap area and 50% shrouding results.

The matrix of assembled modular tube bundles 20 and associated tube support grids 30 and flow guides 40 may be positioned between upper and lower fixturing plates (not shown) which, in the case of heat exchangers employed in high temperature gas cooled reactors, could also incorporate peripheral bypass seals (not shown) in the upper plate and lateral seismic restraint means (not shown) in the lower plate. Support of the flow tube lattice and fixture plate assembly can be accomplished using the same general approach as that employed in known hexagonal modular heat exchanger designs, with the hinge pins 58 serving as the necessary tensioning members.

It is seen that with the flow guides 40 in accordance with the present invention, considerable access to the tube bundles is made available during assembly of the heat exchanger whereby to permit in-situ inspection of the tube bundles. Additionally, adjustment of the flow guides and tube support grids during assembly is greatly facilitated. The employment of substantially identically shaped flow guides and their ability to provide mutually shared partitions between the modular tube bundles permits the flow guides to be manufactured on a mass production basis with attendant benefits in reduced manufacturing costs, handling and tolerance control. The flow guides 40 in accordance with the present invention can be used in substantially all straight-tube modular heat exchange designs installed in cylindrical envelopes and is not dependent upon a particular heading configuration.

An important advantage of the present invention lies in the elimination of the need for interstitial bypass seals between the various modular tube bundles 20. Promotion of intermodule shell-side flow communication between adjacent tube bundles is facilitated through the provision of selectively sized gaps created during assembly of the flow guides 40 to selectively shroud the associated modular tube bundles 20 and associated tube support grids 30. If a tube bundle 20 in accordance with the illustrated embodiment of the invention has a blockage which would normally tend to prevent flow of a gas or liquid longitudinally through the tube bundle, the coolant will flow to adjacent tube bundles through the gaps created at predetermined positions along the lengths of the tube bundles.

The assemblage of flow guides 40 as above described provides structural rigidity for the modular tube bundle array and, coupled with the provision of selectively sized gaps, attenuates the effects of shell-side temperature maldistributions resulting from plugged or inactive modular tube bundles.

While the articulated modular flow guide system of the present invention has been illustrated in conjunction with a recuperator or heat exchanger employed in a high temperature gas cooled reactor, the same flow guide concept may also be applied in gas turbine and process heating plants, as well as other applications where modular tube bundles are employed.

While a preferred embodiment of the flow guide elements and their manner of assembly in accordance with the present invention has been illustrated and described, it will be understood to those skilled in the art that changes and modifications may be made therein without departing from the invention in its broader aspects.

Various features of the invention are defined in the following claims.

What is claimed is:

1. In a heat exchanger flow guide system for supporting and promoting uniform shell-side flow distribution between modular polygonal shaped tube bundles, said system comprising, in combination, a plurality of flow guides each of which includes at least three axisymmetrically-located radial panels defining connecting means at their radial outer edges adapted to facilitate connection with similar flow guides so that a plurality of the flow guides serve to form a staggered polygonal lattice work peripherally about said plurality of polygonal tube bundles defining flow guide channels having mutually shared partitions.

2. The system as defined in claim 1 wherein said connecting means defined on each of said radial panels comprises a connecting sleeve adapted to be positioned in axial alignment with a connecting sleeve on a similar flow guide to facilitate connection therewith.

3. The system as defined in claim 2 wherein said axially aligned connecting sleeves are adapted to receive a connecting pin therethrough.

4. The system as defined in claim 2 wherein said connecting sleeves are formed integral with their respective radial panels and extend a predetermined length along their respective panels less than the longitudinal lengths of the associated flow guides.

5. A system as defined in claim 2 wherein said connecting sleeves extend longitudinally along their respective radial panels a distance sufficient to effect predetermined open space gaps peripherally of each of said polygonal tube receiving channels after assembly of a plurality of said tube guides to form said polygonal tube receiving channels.

6. A system as defined in claim 2 wherein said connecting sleeves extend approximately one-half the longitudinal length of their respective radial panels such that assembly of a plurality of said flow guides facilitates establishment of approximately 67% shrouding of the resulting polygonal tube bundle channels.

7. The system as defined in claim 2 wherein said connecting sleeves are of predetermined axial length to facilitate solid stacking of the connecting sleeves of a plurality of said flow guides.

8. A system as defined in claim 1 wherein a plurality of said flow guides are assembled to define a plurality of hexagonal tube receiving channels, and including at least one tube support grid disposed within each of said hexagonal tube receiving channels, each of said tube support grids being adapted to provide side support for individual flow tubes received within said tube receiving channels so as to maintain said flow tubes in parallel spaced relation.

9. The system as defined in claim 8 wherein said connecting means defined on each of said radial panels comprises a connecting sleeve adapted for axial alignment with connecting sleeves on similar flow guides, each of said tube support grids being adapted for selective connection with said flow guide connecting sleeves so as to fixedly position said tube support grids within said hexagonal tube receiving channels.

10. The system as defined in claim 9 wherein each of said tube support grids includes connecting sleeves adapted for axial alignment with connecting sleeves of said flow guides, said axially aligned connecting sleeves being adapted to receive connecting pins axially therethrough and being of predetermined longitudinal lengths to facilitate solid stacking thereof.

11. The system of claim 10 wherein said connecting sleeves on said tube support grids and said flow guides are of predetermined longitudinal length such that axial stacking thereof establishes open gaps of predetermined area circumferentially of said hexagonal tube receiving chambers.

12. The system of claim 1 wherein said radial panels of each flow guide are integrally connected along common inner longitudinal edges to form a substantially Y-shaped transverse configuration with said radial panels being equiangularly spaced about the axis defined by said common longitudinal edges.

13. The system as defined in claim 5 wherein the longitudinal lengths of said connecting sleeves are selected to effect predetermined open area gaps peripherally of each polygonal tube receiving channel in accordance with the formula:

$$\text{gap area} = A/3B, \text{ where:}$$

A = the overall axial length of each flow guide, and
B = the axial length of each connecting sleeve.

* * * * *